US009149923B2

(12) United States Patent
Campbell et al.

(10) Patent No.: US 9,149,923 B2
(45) Date of Patent: Oct. 6, 2015

(54) OSCILLATING TOOLS AND ACCESSORIES

(75) Inventors: David C. Campbell, Bel Air, MD (US); Mark D. Miller, Airville, PA (US)

(73) Assignee: BLACK & DECKER INC., Newark, DE (US)

( * ) Notice: Subject to any disclaimer, the term of this patent is extended or adjusted under 35 U.S.C. 154(b) by 563 days.

(21) Appl. No.: 13/570,844

(22) Filed: Aug. 9, 2012

(65) Prior Publication Data

US 2013/0126198 A1 May 23, 2013

Related U.S. Application Data

(60) Provisional application No. 61/560,998, filed on Nov. 17, 2011.

(51) Int. Cl.
*E21B 19/00* (2006.01)
*B25F 5/00* (2006.01)

(52) U.S. Cl.
CPC ..... *B25F 5/003* (2013.01)

(58) Field of Classification Search
CPC ..... B23Q 9/0042; B25F 5/00; B25H 1/0078; B27B 9/02; E21B 10/62; E21B 23/03
USPC ..... 173/31, 200, 211
See application file for complete search history.

(56) References Cited

U.S. PATENT DOCUMENTS 1,455,621 A 5/1923 Joyner
2,350,098 A 5/1944 Decker
2,513,271 A 7/1950 Bluemink et al.
2,997,819 A 8/1961 Schact
3,055,497 A 9/1962 Klonski
3,270,785 A 9/1966 Molitor
3,554,197 A 1/1971 Dobbie
3,656,393 A 4/1972 Goellner
3,678,934 A * 7/1972 Warfield et al. ..... 606/79
3,740,847 A 6/1973 Kliever et al.
3,776,647 A 12/1973 Hart
3,802,080 A 4/1974 Peter
3,805,383 A 4/1974 McNally
3,834,019 A 9/1974 Smeltzer et al.

(Continued)

FOREIGN PATENT DOCUMENTS

AT 389668 B 1/1990
CH 685154 A5 4/1995

(Continued)

*Primary Examiner* — Robert Long
(74) *Attorney, Agent, or Firm* — Harness, Dickey & Pierce, P.L.C.

(57) ABSTRACT

A power tool constructed in accordance to one example of the present disclosure can include a repositionable tool accessory. The repositionable tool accessory can be selectively coupled to a first mounting structure on the tool. The repositionable tool accessory can include a tool accessory housing, a rod, a roller, and a locking knob. The tool accessory housing can define a first rod opening and include engaging structure that is configured to cooperatively mate with the first mounting structure. The rod can slidably translate along the first rod opening. The roller can be rotatably coupled to a distal portion of the rod. The locking knob can be movable between an unlocked position wherein the rod is freely translatable along the first rod opening to locate the roller at different locations relative to the output member, and a lock position wherein the rod is fixed relative to the tool accessory housing.

22 Claims, 12 Drawing Sheets

(56) References Cited

U.S. PATENT DOCUMENTS 3,852,881 A 12/1974 Treace
3,905,374 A 9/1975 Winter
3,943,934 A 3/1976 Bent
4,015,371 A 4/1977 Grayston
4,106,181 A * 8/1978 Mattchen ..... 29/450
4,124,956 A 11/1978 Levinson
4,252,121 A 2/1981 Arnegger
4,386,609 A 6/1983 Mongeon
4,421,111 A 12/1983 Rothman
4,461,296 A 7/1984 Hodge
4,475,317 A 10/1984 Dicke
4,538,483 A * 9/1985 Batten ..... 81/56
4,593,590 A 6/1986 Gray
4,597,227 A 7/1986 Gentischer et al.
4,599,077 A 7/1986 Vuillard
4,615,119 A 10/1986 Johnson et al.
4,617,930 A 10/1986 Saunders
4,637,391 A 1/1987 Schlein
4,700,478 A 10/1987 Mezger et al.
4,785,536 A 11/1988 Freyman
4,809,568 A * 3/1989 DeCaro ..... 81/57.37
4,820,090 A 4/1989 Chen
4,825,091 A 4/1989 Breyer et al.
4,905,420 A 3/1990 Flachenecker et al.
RE33,335 E 9/1990 Gentischer et al.
4,972,588 A 11/1990 Briach, Sr.
4,980,976 A 1/1991 Junginger et al.
4,989,374 A 2/1991 Rudolf et al.
5,014,430 A 5/1991 Wortham
5,022,188 A 6/1991 Borst
5,027,684 A 7/1991 Neukam
5,035,165 A * 7/1991 Madsen ..... 83/618
5,038,478 A 8/1991 Mezger et al.
5,064,325 A 11/1991 McRoskey
5,107,737 A 4/1992 Tagliaferri
5,122,142 A 6/1992 Pascaloff
5,157,873 A 10/1992 Rudolf et al.
5,199,223 A 4/1993 Rudolf et al.
5,263,283 A 11/1993 Rudolf et al.
5,263,972 A * 11/1993 Evans et al. ..... 606/176
5,265,340 A 11/1993 Nitz et al.
5,265,343 A 11/1993 Pascaloff
5,269,784 A 12/1993 Mast
D343,247 S 1/1994 Walen
5,303,688 A 4/1994 Chiuminatta et al.
5,306,285 A 4/1994 Miller et al.
5,307,709 A 5/1994 Bareis et al.
5,309,805 A 5/1994 Mezger et al.
5,319,889 A 6/1994 Rudolf et al.
5,324,052 A * 6/1994 Ortmann ..... 279/83
D351,907 S 10/1994 Matthai et al.
5,352,229 A 10/1994 Goble et al.
5,363,733 A * 11/1994 Baird et al. ..... 83/786
5,366,312 A 11/1994 Raines
5,366,457 A 11/1994 McGuire et al.
5,421,091 A 6/1995 Gerritsen, Jr.
5,435,066 A 7/1995 Bare et al.
5,437,571 A 8/1995 Everts et al.
5,440,811 A 8/1995 Challis
5,441,450 A 8/1995 Fein et al.
D362,065 S 9/1995 Goris
5,465,492 A 11/1995 Bond
5,468,247 A 11/1995 Matthai et al.
5,470,272 A 11/1995 Kikuchi et al.
5,480,409 A 1/1996 Riza
5,482,499 A 1/1996 Satoh
5,484,094 A * 1/1996 Gupta ..... 227/8
5,489,285 A * 2/1996 Goris ..... 606/82
5,496,316 A 3/1996 Goris
D368,777 S 4/1996 Goble et al.
5,507,763 A 4/1996 Petersen et al.
5,527,207 A 6/1996 Azar et al.
5,533,926 A 7/1996 Nemazi
D374,286 S 10/1996 Goble et al.
D374,287 S 10/1996 Goble et al.
D374,482 S 10/1996 Goble et al.
5,569,257 A 10/1996 Arnegger et al.
5,588,213 A 12/1996 Swanberg
5,607,343 A 3/1997 Keith, Jr. et al.
5,637,034 A 6/1997 Everts et al.
5,648,247 A 7/1997 Picataggio et al.
5,651,727 A 7/1997 Weinstein et al.
5,653,033 A 8/1997 McDowell
5,658,304 A 8/1997 Lim
5,676,680 A 10/1997 Lim
5,681,213 A 10/1997 Hashii
5,694,693 A 12/1997 Hutchins et al.
5,697,835 A 12/1997 Nitz et al.
5,702,415 A 12/1997 Matthai et al.
5,725,422 A 3/1998 Leweck
5,729,904 A 3/1998 Trott
5,735,866 A 4/1998 Adams et al.
5,782,749 A 7/1998 Riza
5,785,571 A 7/1998 Camp
5,815,932 A 10/1998 Presher et al.
5,829,931 A 11/1998 Doumani
5,833,524 A 11/1998 Satoh et al.
5,839,196 A 11/1998 Trott
5,843,122 A 12/1998 Riza
5,868,208 A 2/1999 Peisert et al.
5,868,784 A 2/1999 Riza
5,870,827 A 2/1999 Holst
5,902,080 A 5/1999 Kopras
5,918,685 A 7/1999 Ulbrich et al.
5,928,256 A 7/1999 Riza
5,935,126 A 8/1999 Riza
5,947,804 A 9/1999 Fukinuki et al.
5,957,469 A 9/1999 Miles et al.
5,969,312 A 10/1999 Svetlik et al.
6,013,079 A 1/2000 Salam
6,021,573 A 2/2000 Kikuchi et al.
6,021,854 A 2/2000 Scarola
6,044,559 A 4/2000 Holst
6,048,260 A * 4/2000 Kopras ..... 451/358
6,057,518 A 5/2000 Bascom et al.
6,062,960 A 5/2000 Kai et al.
6,073,939 A 6/2000 Steadings et al.
6,082,515 A 7/2000 Oono et al.
6,099,397 A 8/2000 Wurst
6,108,916 A 8/2000 Zeiler et al.
6,116,996 A 9/2000 Yanase
6,125,721 A 10/2000 Yang
6,132,282 A 10/2000 Camp
6,132,300 A 10/2000 Martin
6,145,723 A * 11/2000 Gupta ..... 227/8
6,153,838 A 11/2000 Wadge
6,179,301 B1 1/2001 Steadings et al.
6,193,724 B1 2/2001 Chan
6,196,554 B1 3/2001 Gaddis et al.
6,241,259 B1 6/2001 Gaddis et al.
6,241,594 B1 6/2001 Lepold
6,301,790 B1 10/2001 Zeiler et al.
6,306,024 B1 10/2001 Kai et al.
6,340,022 B1 1/2002 Schroer
6,340,802 B1 1/2002 Bascom et al.
6,430,465 B2 8/2002 Cutler
6,434,835 B1 8/2002 Grunikiewicz et al.
6,435,521 B2 8/2002 Steadings et al.
D462,766 S 9/2002 Jacobs et al.
6,449,852 B1 9/2002 Simantel
6,470,772 B2 10/2002 Peisert et al.
6,488,287 B2 12/2002 Gaddis et al.
6,499,381 B2 12/2002 Ladish et al.
6,536,536 B1 3/2003 Gass et al.
6,538,218 B2 3/2003 Bascom et al.
6,555,773 B1 4/2003 Broghammer et al.
6,569,001 B2 5/2003 Rudolf et al.
6,588,111 B2 7/2003 Williams
6,588,112 B2 7/2003 Zeiler et al.
6,632,226 B2 10/2003 Chan
6,648,742 B1 11/2003 Segiel, Jr.
6,653,584 B1 11/2003 Chen
6,678,062 B2 1/2004 Haugen et al.
6,678,960 B2 1/2004 Williams

(56) References Cited

U.S. PATENT DOCUMENTS 6,684,481 B2 2/2004 Kullmer
6,705,807 B1 3/2004 Rudolph et al.
6,735,875 B1 5/2004 Eslambolchi et al.
6,747,745 B2 6/2004 Ishikawa et al.
6,753,490 B2 6/2004 Svetlik et al.
6,769,338 B2 8/2004 Svetlik et al.
6,796,888 B2 9/2004 Jasch
6,802,764 B2 10/2004 Besch
6,832,764 B2 12/2004 Steadings et al.
6,834,730 B2 12/2004 Gass et al.
6,851,898 B2 2/2005 Ege et al.
6,861,598 B2 3/2005 Bascom et al.
6,865,813 B2 3/2005 Pollak
6,869,346 B2 3/2005 Wendt et al.
6,890,135 B2 5/2005 Kopras et al.
6,896,073 B2 5/2005 Fuchs
6,896,679 B2 5/2005 Danger et al.
6,898,860 B2 5/2005 Wu
6,918,720 B2 * 7/2005 Kopras et al. ..... 409/182
6,945,862 B2 9/2005 Jasch et al.
6,949,110 B2 9/2005 Ark et al.
6,968,933 B2 11/2005 Buckhouse et al.
7,001,403 B2 2/2006 Hausmann et al.
7,015,445 B2 3/2006 Bishop
7,040,972 B2 5/2006 Hoffmann et al.
7,047,650 B2 5/2006 Chen
7,077,735 B2 7/2006 Krondorfer et al.
7,093,668 B2 8/2006 Gass et al.
7,094,011 B2 8/2006 Kopras et al.
7,096,588 B2 8/2006 Zeiler et al.
7,096,972 B2 * 8/2006 Orozco, Jr. ..... 173/171
7,108,077 B2 9/2006 Zaiser
7,115,027 B2 10/2006 Thomaschewski
7,121,358 B2 10/2006 Gass et al.
7,128,503 B2 10/2006 Steadings et al.
7,144,206 B2 12/2006 Burger et al.
7,169,025 B2 1/2007 Schumacher
7,175,625 B2 2/2007 Culbert
7,179,262 B2 2/2007 Bryan et al.
7,189,239 B2 3/2007 Fisher et al.
7,191,526 B2 3/2007 Zeiler et al.
7,207,873 B2 4/2007 Hesse et al.
7,217,177 B2 5/2007 Frech et al.
7,223,161 B2 5/2007 Kodani et al.
7,237,988 B2 7/2007 Steadings et al.
7,258,351 B2 8/2007 Hoffmann et al.
7,258,515 B2 8/2007 Krondorfer
7,293,362 B2 11/2007 Konen
7,300,337 B1 11/2007 Sun et al.
7,308,764 B2 12/2007 Zeiler et al.
7,310,879 B1 12/2007 Clarke et al.
7,328,752 B2 2/2008 Gass et al.
7,344,435 B2 3/2008 Pollak et al.
7,392,568 B2 7/2008 Koschel et al.
7,418,892 B2 9/2008 Taylor
7,447,565 B2 11/2008 Cerwin
7,476,821 B1 1/2009 Knuppel
7,478,979 B2 1/2009 Zhou et al.
7,481,608 B2 1/2009 Zhou et al.
7,497,152 B2 3/2009 Zeiler et al.
7,497,860 B2 * 3/2009 Carusillo et al. ..... 606/82
7,507,242 B2 3/2009 Triplett et al.
7,537,065 B2 5/2009 Gallagher et al.
7,540,068 B2 6/2009 Powell et al.
7,540,334 B2 6/2009 Gass et al.
7,588,578 B2 9/2009 Triplett et al.
7,635,293 B2 12/2009 Sun et al.
7,677,281 B2 3/2010 Baker et al.
7,690,871 B2 4/2010 Steadings et al.
7,691,106 B2 4/2010 Schenberger et al.
7,699,566 B2 4/2010 Nickels, Jr. et al.
7,717,191 B2 5/2010 Trautner
7,717,192 B2 5/2010 Schroeder et al.
7,726,917 B2 6/2010 Mack
7,735,575 B2 6/2010 Trautner
7,739,801 B1 6/2010 Crain et al.
7,739,802 B2 6/2010 Crain et al.
7,746,448 B2 6/2010 Franitza et al.
7,753,381 B2 7/2010 Nickels, Jr. et al.
7,762,349 B2 7/2010 Trautner et al.
7,770,574 B1 * 8/2010 Ferreira ..... 125/13.01
7,784,166 B2 8/2010 Tanner
7,798,245 B2 9/2010 Trautner
7,805,805 B2 10/2010 Loveless
7,815,648 B2 10/2010 Triplett et al.
7,833,241 B2 11/2010 Gant
7,841,601 B2 11/2010 Mack
7,854,274 B2 12/2010 Trautner et al.
7,854,649 B2 12/2010 Bohne et al.
7,871,227 B2 * 1/2011 Adamczak et al. ..... 409/182
7,891,101 B2 * 2/2011 Brady ..... 30/371
7,950,152 B2 5/2011 Gallego
7,976,253 B2 7/2011 Steadings et al.
7,984,556 B2 7/2011 Konen
7,987,920 B2 8/2011 Schroeder et al.
7,997,586 B2 8/2011 Ziegler et al.
8,011,398 B2 9/2011 Loveless et al.
8,038,156 B2 10/2011 Nickels, Jr. et al.
8,047,100 B2 11/2011 King
8,070,168 B2 12/2011 Mack
8,109,343 B2 2/2012 Schroeder et al.
2001/0041524 A1 11/2001 Steiger et al.
2002/0131267 A1 9/2002 Van Osenbruggen
2002/0198556 A1 12/2002 Ark et al.
2003/0014067 A1 1/2003 Kullmer et al.
2003/0070307 A1 4/2003 Walker
2003/0196336 A1 * 10/2003 Alsruhe ..... 30/371
2004/0128836 A1 7/2004 Garrett
2004/0204731 A1 10/2004 Gant
2004/0243136 A1 12/2004 Gupta et al.
2005/0120819 A1 6/2005 Kawada
2005/0178261 A1 8/2005 Thomaschewski
2005/0221738 A1 10/2005 Cooper et al.
2006/0060365 A1 3/2006 Kunz
2006/0172669 A1 8/2006 Hesse et al.
2006/0217048 A1 9/2006 Frech et al.
2006/0272468 A1 12/2006 Gupta et al.
2006/0282108 A1 * 12/2006 Tanner ..... 606/176
2007/0065245 A1 * 3/2007 Carlson et al. ..... 409/182
2007/0093190 A1 4/2007 Schomisch
2007/0209162 A1 9/2007 McRoberts et al.
2007/0229853 A1 10/2007 Cheng
2007/0295156 A1 12/2007 Ziegler et al.
2007/0295165 A1 12/2007 Tanaka et al.
2008/0027449 A1 * 1/2008 Gundlapalli et al. ..... 606/82
2008/0099053 A1 5/2008 Loveless
2008/0134518 A1 6/2008 Martin
2008/0190259 A1 8/2008 Bohne
2008/0196910 A1 8/2008 Radle et al.
2008/0196911 A1 8/2008 Krapf et al.
2008/0243125 A1 10/2008 Guzman et al.
2009/0013540 A1 1/2009 Bohne
2009/0023371 A1 1/2009 Blickle et al.
2009/0024134 A1 1/2009 Triplett et al.
2009/0084567 A1 * 4/2009 Basham et al. ..... 173/29
2009/0138017 A1 5/2009 Carusillo et al.
2009/0181604 A1 7/2009 Loveless et al.
2009/0181605 A1 7/2009 Loveless et al.
2009/0181606 A1 7/2009 Loveless et al.
2009/0183377 A1 7/2009 Loveless et al.
2009/0186559 A1 7/2009 Loveless et al.
2009/0197514 A1 * 8/2009 Peisert ..... 451/356
2009/0198465 A1 8/2009 Decker et al.
2009/0277022 A1 11/2009 Limberg et al.
2009/0283283 A1 11/2009 Oesterle et al.
2009/0312761 A1 * 12/2009 Boykin et al. ..... 606/82
2009/0312762 A1 12/2009 Boykin
2009/0312779 A1 12/2009 Boykin et al.
2009/0318065 A1 12/2009 Zaiser et al.
2009/0320625 A1 12/2009 Kildevaeld
2010/0003906 A1 1/2010 Zaiser et al.
2010/0009613 A1 1/2010 Frueh
2010/0019014 A1 * 1/2010 Rodenhouse ..... 227/32
2010/0052269 A1 3/2010 Zaiser et al.

(56) References Cited

U.S. PATENT DOCUMENTS

| | | | | |
|---|---|---|---|---|
| 2010/0053940 | A1 | 3/2010 | Yaksich | |
| 2010/0056029 | A1 | 3/2010 | Grunikiewicz | |
| 2010/0170538 | A1 | 7/2010 | Baker et al. | |
| 2010/0193207 | A1 | 8/2010 | Mok et al. | |
| 2010/0197208 | A1 | 8/2010 | Blickle et al. | |
| 2010/0206596 | A1 | 8/2010 | Kamegai et al. | |
| 2010/0275450 | A1 | 11/2010 | Refson | |
| 2010/0288099 | A1 | 11/2010 | Steiger | |
| 2010/0300714 | A1 | 12/2010 | Trautner | |
| 2010/0316457 | A1 | 12/2010 | Wasielewski | |
| 2011/0000690 | A1 | 1/2011 | Kildevaeld | |
| 2011/0011605 | A1 | 1/2011 | Kildevaeld | |
| 2011/0011609 | A1 | 1/2011 | Simm et al. | |
| 2011/0046627 | A1 | 2/2011 | Kim | |
| 2011/0067894 | A1 | 3/2011 | Bernardi | |
| 2011/0072946 | A1 | 3/2011 | Bernardi et al. | |
| 2011/0083330 | A1 | 4/2011 | Steele et al. | |
| 2011/0086582 | A1 | 4/2011 | Takemura et al. | |
| 2011/0097978 | A1 | 4/2011 | Hofmann et al. | |
| 2011/0131766 | A1 | 6/2011 | Imaschewski et al. | |
| 2011/0139473 | A1* | 6/2011 | Braun et al. | 173/20 |
| 2011/0147023 | A1 | 6/2011 | Herr | |
| 2011/0185869 | A1 | 8/2011 | Wasielewski et al. | |
| 2011/0214892 | A1* | 9/2011 | Hecht et al. | 173/164 |
| 2011/0245833 | A1 | 10/2011 | Anderson | |
| 2011/0266014 | A1* | 11/2011 | McRoberts et al. | 173/170 |
| 2011/0266757 | A1 | 11/2011 | Steadings et al. | |
| 2011/0266758 | A1* | 11/2011 | Sergyeyenko et al. | 279/106 |
| 2011/0266759 | A1* | 11/2011 | Goldman | 279/106 |
| 2011/0272172 | A1 | 11/2011 | Lau et al. | |
| 2011/0315413 | A1* | 12/2011 | Fisher et al. | 173/1 |
| 2011/0315414 | A1 | 12/2011 | Kuntner et al. | |
| 2012/0025476 | A1 | 2/2012 | Nickels, Jr. et al. | |
| 2012/0031636 | A1 | 2/2012 | King | |
| 2012/0073410 | A1 | 3/2012 | Hoffman et al. | |
| 2012/0090863 | A1 | 4/2012 | Puzio et al. | |
| 2012/0211951 | A1* | 8/2012 | Montplaisir et al. | 279/141 |
| 2012/0228354 | A1* | 9/2012 | Schwartzenberger | 227/109 |
| 2013/0193655 | A1* | 8/2013 | Kaye et al. | 279/141 |

FOREIGN PATENT DOCUMENTS

| | | | |
|---|---|---|---|
| DE | 3138516 | A1 | 8/1982 |
| DE | 3304981 | C1 | 6/1984 |
| DE | 3520417 | A1 | 12/1985 |
| DE | 3619632 | A1 | 12/1987 |
| DE | 3640516 | C1 | 4/1988 |
| DE | 3833735 | A1 | 4/1989 |
| DE | 3801141 | A1 | 7/1989 |
| DE | 8618695 | U1 | 9/1989 |
| DE | 3912991 | A1 | 10/1990 |
| DE | 4017038 | A1 | 4/1991 |
| DE | 4406718 | A1 | 8/1995 |
| DE | 29607061 | U1 | 10/1996 |
| DE | 29810157 | U1 | 8/1998 |
| DE | 19736933 | C1 | 10/1998 |
| DE | 29907671 | U1 | 8/1999 |
| DE | 29809788 | U1 | 9/1999 |
| DE | 19825408 | A1 | 12/1999 |
| DE | 19938106 | C1 | 4/2001 |
| DE | 20109786 | U1 | 10/2002 |
| DE | 102004020982 | A1 | 11/2005 |
| DE | 202006001643 | U1 | 3/2006 |
| DE | 102004050798 | A1 | 4/2006 |
| DE | 102004050799 | A1 | 4/2006 |
| DE | 102006020420 | A1 | 10/2007 |
| DE | 202004021498 | U1 | 6/2008 |
| DE | 102007018465 | A1 | 10/2008 |
| DE | 102007018467 | A1 | 10/2008 |
| DE | 202009004549 | U1 | 6/2009 |
| DE | 202008001759 | U1 | 7/2009 |
| DE | 102008001234 | A1 | 10/2009 |
| DE | 202009013147 | U1 | 1/2010 |
| EP | 0443362 | A2 | 8/1991 |
| EP | 0554929 | A1 | 8/1993 |
| EP | 0776634 | A2 | 6/1997 |
| EP | 0962283 | A1 | 12/1999 |
| EP | 1190800 | A2 | 3/2002 |
| EP | 1694477 | A1 | 6/2005 |
| EP | 1625909 | A1 | 2/2006 |
| EP | 1687120 | A1 | 8/2006 |
| EP | 1819490 | A1 | 8/2007 |
| EP | 1852218 | A1 | 11/2007 |
| EP | 1882538 | A2 | 1/2008 |
| EP | 2085182 | A1 | 8/2009 |
| EP | 2143531 | A1 | 1/2010 |
| EP | 2152475 | A1 | 2/2010 |
| EP | 2159000 | A1 | 3/2010 |
| JP | 62188612 | A | 8/1987 |
| JP | 1158205 | A | 6/1989 |
| JP | 07169362 | A | 7/1995 |
| JP | 10230473 | A | 9/1998 |
| JP | 2006263914 | A | 10/2006 |
| WO | WO-03097299 | A1 | 11/2003 |
| WO | WO-2004043269 | A1 | 5/2004 |
| WO | WO-2005056256 | A1 | 6/2005 |
| WO | WO-2006017066 | A2 | 2/2006 |
| WO | WO-2009151958 | A2 | 12/2009 |
| WO | WO-2009151959 | A1 | 12/2009 |
| WO | WO-2009151965 | A1 | 12/2009 |
| WO | WO-2012089636 | A1 | 7/2012 |
| WO | WO-2012089638 | A1 | 7/2012 |
| WO | WO-2012089639 | A1 | 7/2012 |
| WO | WO-2012089642 | A2 | 7/2012 |

* cited by examiner

OSCILLATING TOOLS AND ACCESSORIES

CROSS-REFERENCE TO RELATED APPLICATIONS

This application claims the benefit of U.S. Provisional Application No. 61/560,998, filed on Nov. 17, 2011. This application relates to U.S. patent application Ser. No. 12/942,098, filed on Nov. 9, 2010, U.S. patent application Ser. No. 13/044,811, filed on Mar. 10, 2011, and U.S. patent application Ser. No. 13/362,480, filed on Jan. 31, 2012. The entire disclosures of each of the above applications are incorporated herein by reference.

FIELD

The present disclosure relates to power hand tools, and more specifically, to a repositionable tool accessory selectively secured to the power hand tool.

BACKGROUND

This section provides background information related to the present disclosure which is not necessarily prior art.

Power hand tools are provided in many examples for performing a wide range of tasks. For example, some power hand tools can include an output member that is driven by a motor and that couples with an accessory to perform a working operation onto a work piece. For example, some hand tools can provide various configurations for attaching cutting accessories, grinding accessories, sanding accessories, and the like. Some power hand tools are configured as oscillating tools that are operable to transmit an oscillating motion onto the accessory.

During the course of performing a working operation, a user may want to maintain the accessory at a certain distance relative to the work piece.

SUMMARY

This section provides a general summary of the disclosure, and is not a comprehensive disclosure of its full scope or all of its features.

A power tool constructed in accordance with one example of the present disclosure can include a tool housing, a motor, a first mounting structure, and a repositionable tool accessory. The motor can be disposed in the tool housing and configured to drive an output member. The first mounting structure can be arranged on the tool housing. The repositionable tool accessory can be selectively coupled to the first mounting structure. The repositionable tool accessory can include a tool accessory housing, a rod, a roller, and a locking knob. The tool accessory housing can define a first rod opening and include engaging structure that is configured to cooperatively mate with the first mounting structure. The rod can have a proximal portion, an intermediate portion, and a distal portion. The rod can slidably translate along the first rod opening. The roller can be rotatably coupled to the distal portion of the rod. The locking knob can be coupled to the tool accessory housing and be movable between an unlocked position wherein the rod is freely translatable along the first rod opening to locate the roller at different locations relative to the output member, and a lock position wherein the rod is fixed relative to the tool accessory housing.

According to additional features, the tool accessory housing further defines a second rod opening, distinct from the first rod opening and configured to selectively and alternatively accept the proximal portion of the rod. One of the first mounting structure and the engaging structure can comprise at least one inset and the other of the first mounting structure and the engaging structure can comprise at least one outset. The at least one outset is configured to non-rotatingly nest within the at least one inset. The at least one inset can comprise three insets. The at least one outset can comprise three outsets. The inset and outsets can have a rectangular geometry.

According to additional features, the repositionable tool accessory can further comprise a fastener that extends through the at least one inset and outset. The fastener can threadably engage the mounting structure to fix the tool accessory housing to the tool housing.

According to other features, the distal portion of the rod can extend along a distal axis. The proximal portion of the rod can extend along a proximal axis. The distal and proximal axes are non-intersecting and substantially transverse. The intermediate portion can extend along an intermediate axis that intersects with and is substantially transverse relative to the proximal axis. The rod can have a flat formed at the proximal portion. The locking knob can selectively engage the flat.

According to still other features, the power tool can comprise a second mounting structure arranged on an opposite side of the tool housing relative to the first mounting structure. The second mounting structure can be configured to selectively couple with a second repositionable tool accessory.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 14:
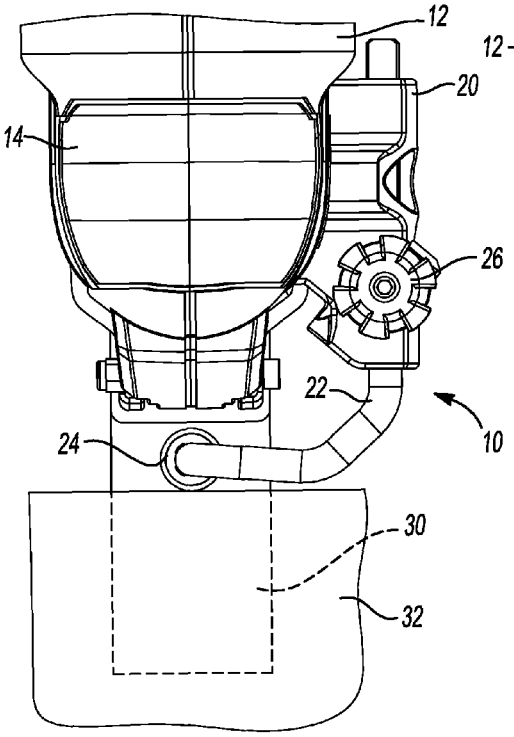
FIG. 14 is a top view of the power tool shown in FIG. 1 and shown with the repositionable tool accessory adjusted to a first position.
Figure 15:
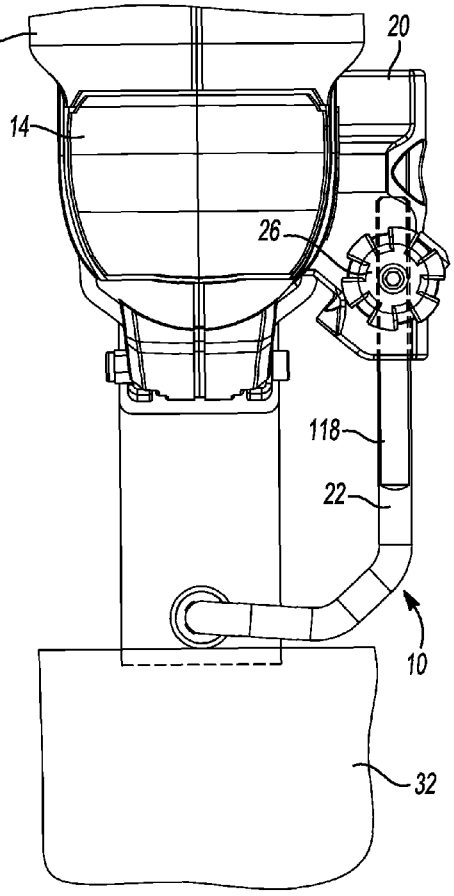
FIG. 15 is a top view of the power tool of FIG. 14 and shown with the repositionable tool accessory adjusted to a second position.
Figure 17:
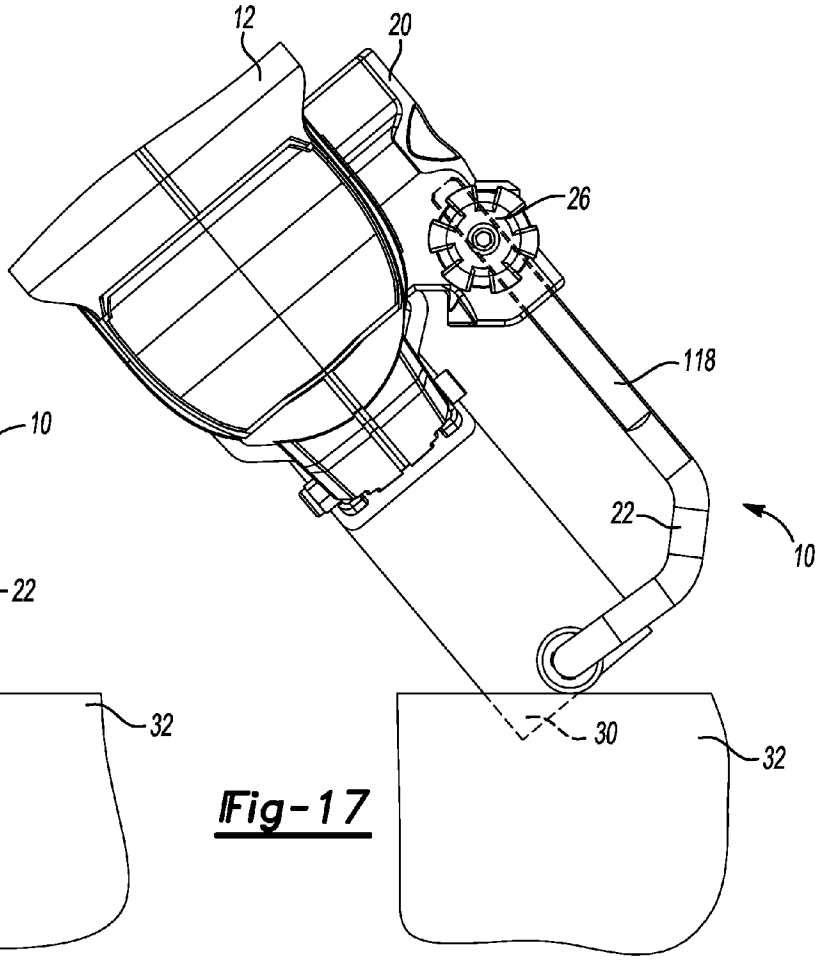
Figure 16:
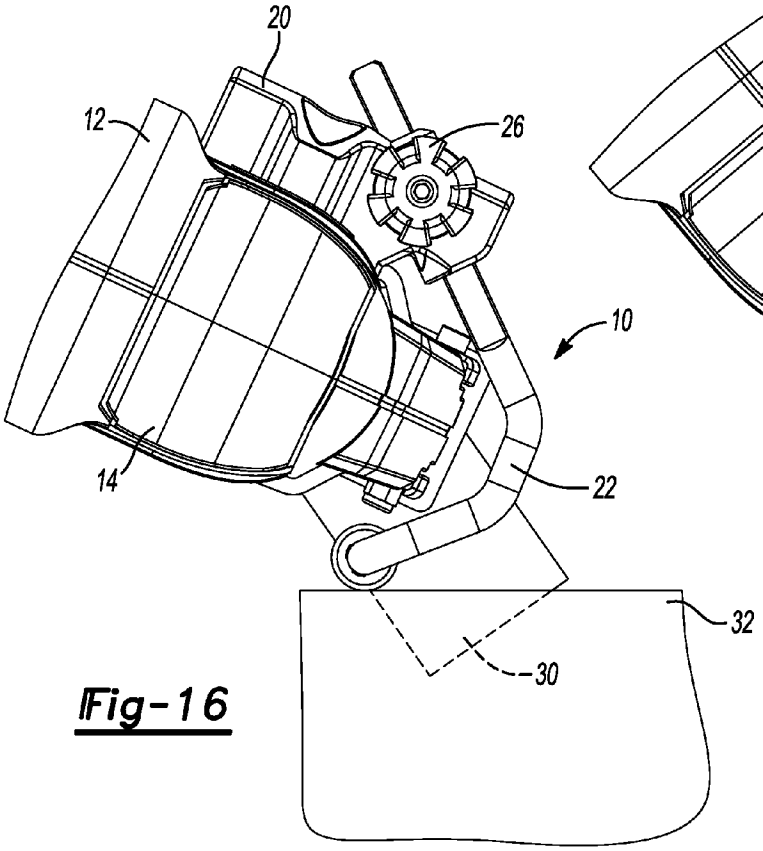

FIG. 16 is another top view of the power tool of FIG. 14 and shown with the repositionable tool accessory in the first position and shown with the power tool oriented at an angle relative to a work piece; and FIG. 17 is a top view of the power tool of FIG. 15 and shown with the repositionable tool accessory in the second position and shown with the power tool oriented at an angle relative to the work piece.

Corresponding reference numerals indicate corresponding parts throughout the several views of the drawings.

DETAILED DESCRIPTION

Example embodiments will now be described more fully with reference to the accompanying drawings.

Figure 1:
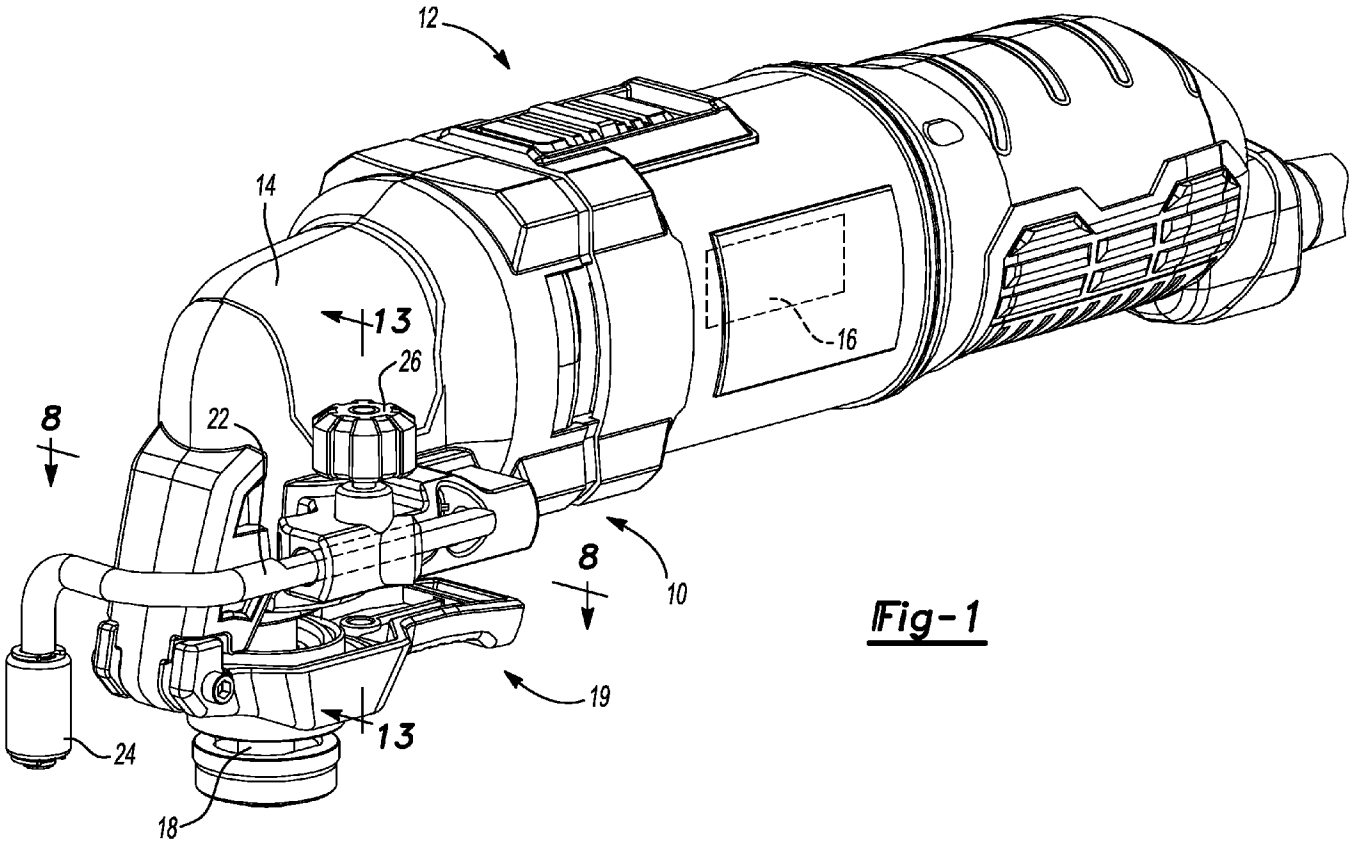
FIG. 1 is a front perspective view of a power tool incorporating a repositionable tool accessory constructed in accordance to one example of the present disclosure.

With initial reference to FIG. 1, a repositionable tool accessory constructed in accordance to one example of the present disclosure is shown and generally identified at reference numeral 10. The repositionable tool accessory 10 is shown coupled to a power tool 12. The power tool 12 can be a hand held oscillating tool comprising a tool housing 14 having a motor 16 that is drivingly engaged to an output member 18. A clamp assembly 19 can be disposed on the tool housing 14 and configured to selectively clamp an accessory (such as accessory 30, FIG. 14) to the power tool 12. Additional description of the clamp assembly 19 may be found in the commonly owned U.S. patent application Ser. No. 13/362,480 identified above. The power tool 12 can generally be a handheld power tool that may be powered by alternating current (AC) or direct current (DC). It will be appreciated however, that while the configuration of the power tool 12 is in the form of a hand held oscillating tool, the configuration is merely exemplary. In this regard, the repositionable tool accessory 10 can be configured for mating with other power tools. The repositionable tool accessory 10 disclosed herein can be used in a number of capacities such as, but not limited to, a depth stop, a stationary tool mount, a circle cutter, a mount for a dust collector nozzle that may go to a vacuum, a mount for a dust/chip blower tube for dry cutting, a work light mount, a cut-off width guide, a mount for a sensor, a pipe cutting guide, and a mount for a secondary/auxiliary tool including a small manual file such as for deburring cut edges. Other uses are contemplated.

With additional reference now to FIGS. 2-7, the repositionable tool accessory 10 will be described in greater detail. The repositionable tool accessory 10 can generally comprise a tool accessory housing 20, a depth stop rod 22, a roller 24, and a locking member or knob 26. In general, the depth stop rod 22 can be adjustably positioned relative to the tool accessory housing 20 in a number of positions to locate the roller 24 at a desired offset relative to the output member 18. As will become appreciated from the following discussion, the repositionable tool accessory 10 can therefore allow a user to position the roller 24 at a desired location relative to an accessory 30 driven by the output member 18 (see FIGS. 14-17). The roller 24 can therefore be positioned to locate relative to and/or roll against a work piece 32. In this regard, a user is given greater control over the accessory 30 to predict the penetration of cut of the accessory 30 into the work piece 32. In other examples, the roller 24 can be positioned relative to the work piece 32 to position other accessories such as a sanding platen, for example, at a desired location against the work piece 32. The locking member 26, while illustrated as a knob, may be configured differently, such as a cam mechanism having a clamp and a lever.

Figure 5:
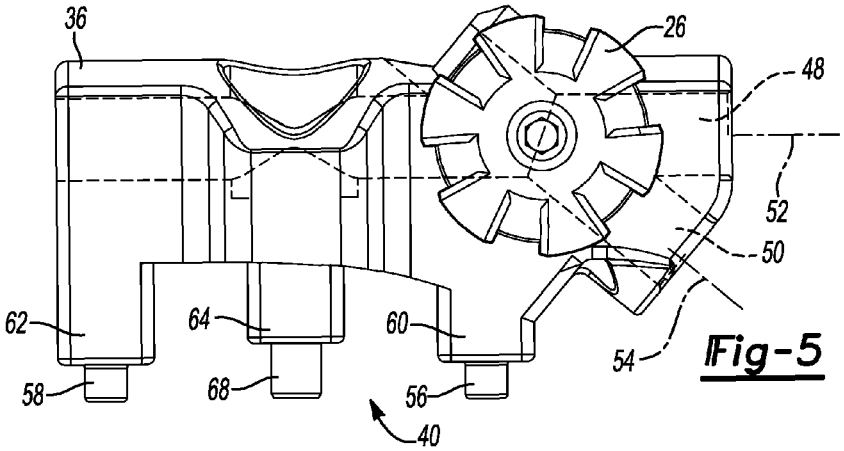
FIG. 5 is a top view of the tool accessory housing of FIG. 3.
Figure 6:
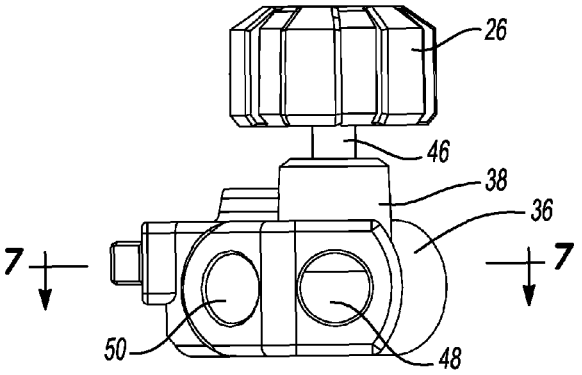
FIG. 6 is a front view of the tool accessory housing of FIG. 3.
Figure 7:
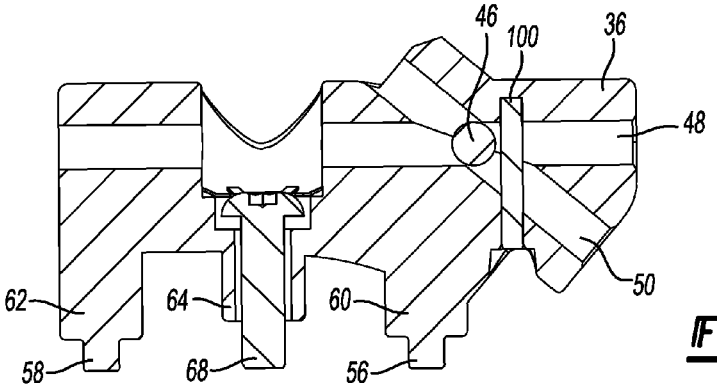
FIG. 7 is a cross-sectional view taken along lines 7-7 of FIG. 6.

The tool accessory housing 20 can generally include a housing body 36 that includes a boss 38 and an engaging structure 40. The boss 38 can define a knob opening 44 that receives an axle 46 extending from the locking knob 26. The knob opening 44 can be threaded. The housing body 36 can further define a first rod opening 48 and a second rod opening 50. As best illustrated in FIG. 5, the first rod opening 48 can extend along a first axis 52 while the second rod opening 50 can extend along a second axis 54. The first and second axes 52 and 54 are non-parallel and intersecting. As will become appreciated from the following discussion, the depth stop rod 22 can be selectively and alternatively located through the first or second rod openings 48 and 50 to orient the depth stop rod 22 (and therefore the roller 24) at different locations relative to the tool housing 14. The engaging structure 40 can generally include a first locating pin 56 and a second locating pin 58. The first and second locating pins 56 and 58 can extend from first and second outsets 60 and 62, respectively, formed on the housing body 36. A third outset 64 can be arranged at a location generally between the first and second outsets 60 and 62 on the housing body 36. A fastener 68 can be arranged for extending through an opening 70 in the third outset 64. The fastener 68 can cooperate with a washer 74 and a lock washer 76. While the fastener 68 is shown cooperating with the third outset 64 in a location between the first and second outsets 60 and 62, other configurations are contemplated. For example, a fastener can be additionally or alternatively configured for use with the first and second outsets 60 and 62.

The engaging structure 40 is configured to selectively mate with a first mounting structure 80 (FIG. 2) configured on the tool housing 14. The first mounting structure 80 can generally comprise a first, second, and third inset 82, 84, and 86, respectively. In the example provided, the first inset 82 can be configured to receive the first outset 60 of the housing body 36. The second inset 84 can be configured to slidably receive the second outset 62 of the housing body 36. The third inset 86 can be configured to slidably receive the third outset 64 of the housing body 36. In the example shown, the respective outsets 60, 62, and 64 can have a geometry that non-rotatably mates with the respective insets 82, 84, and 86. In the example shown, the geometries of the respective outsets 60, 62, and 64 and insets 82, 84, and 86 are rectangular although other geometries may be used. During assembly, the engaging structure 40 can be advanced toward the first mounting structure 80. Specifically, the first, second and third outsets 60, 62, and 64 can be slidably inserted into the first, second and third insets 82, 84, and 86. Concurrently, the first locating pin 56 can be received into an opening 92. The second locating pin 58 can be inserted into an opening 94. The fastener 68 can be located into an opening 96 in the first mounting structure 80. In the example shown, the fastener 68 can be threadably advanced into the opening 96 to further lock the tool accessory housing 20 to the first mounting structure 80 of the tool housing 14. The engaging structure 40 and mounting structure 80 cooperate to provide a robust and secure connection that resists rotation of the tool accessory housing 20 relative to the tool housing 14.

The tool accessory housing 20 can further include a dowel pin 100 that can be configured to slidably engage the depth stop rod 22. The dowel pin 100 can assist in slidably advancing the depth stop rod 22 along the first rod opening 48 or the second rod opening 50 (see also FIG. 7). The axle 46 of the locking knob 26 can be configured to threadably advance into the knob opening 44 along an axis of the axle to move the locking knob 26 into and out of locking engagement with the depth stop rod 22. In this regard, the locking knob 26 can lock the depth stop rod 22 at a desired location.

Figure 2:
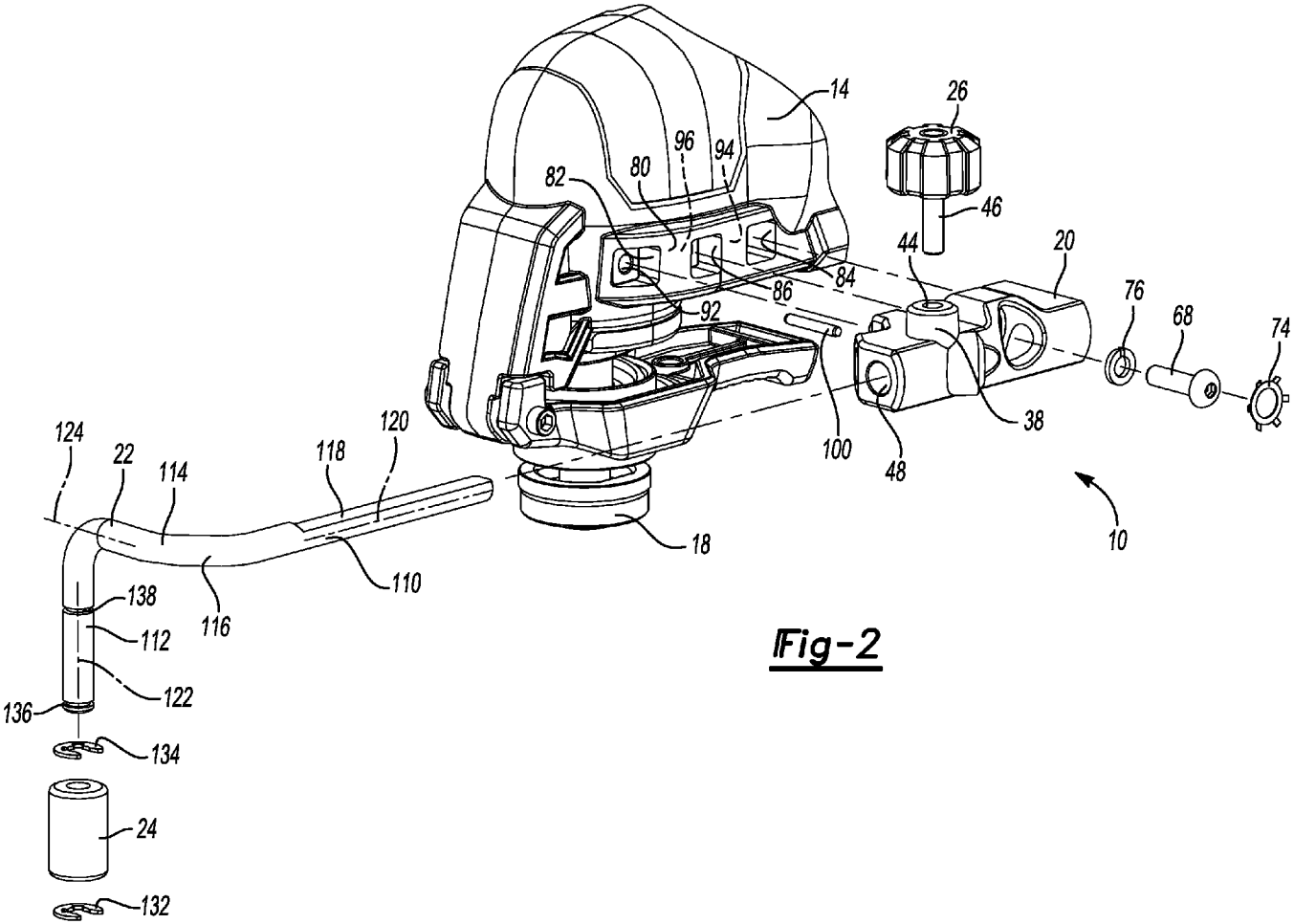
FIG. 2 is an exploded front perspective view of the repositionable tool accessory of FIG. 1.
Figure 3:
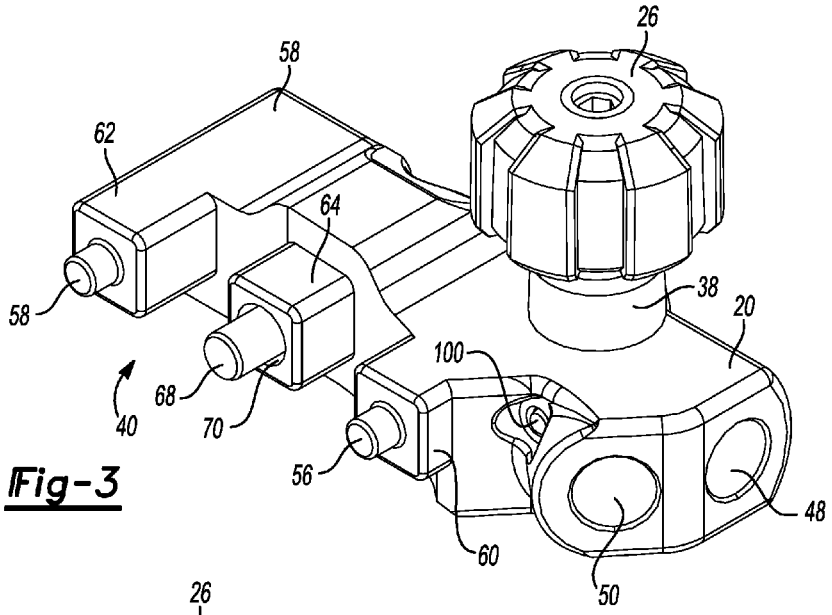
FIG. 3 is a first side perspective view of a tool accessory housing of the repositionable tool accessory of FIG. 2.
Figure 4:
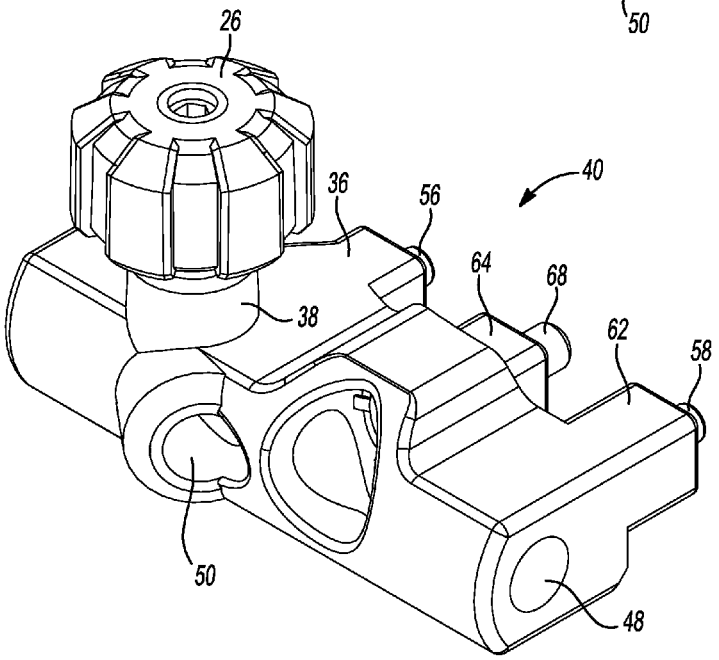
FIG. 4 is a second side perspective view of the tool accessory housing of FIG. 3.
Figure 8:
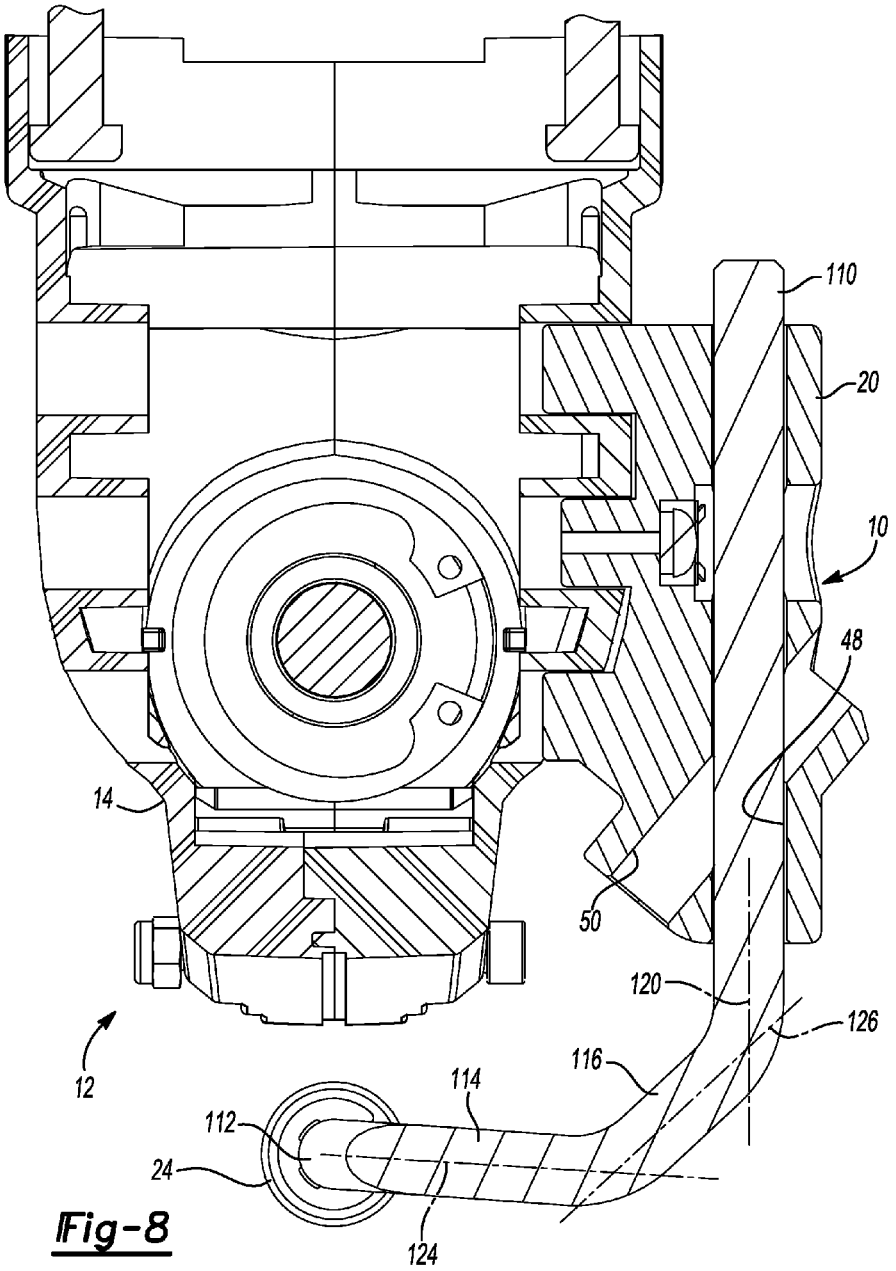
FIG. 8 is a cross-sectional view taken along lines 8-8 of FIG. 1.

The depth stop rod 22 can generally include a proximal portion 110, a distal portion 112, a first intermediate portion 114 and a second intermediate portion 116. The proximal portion 110 can include a flat 118 formed thereon. The flat 118 can be configured to engage the axle 46 of the locking knob 26. The proximal portion 110 can be arranged along a proximal axis 120 (FIG. 8). The distal portion 112 can be arranged along a distal axis 122 (FIG. 2). The first intermediate portion 114 can be arranged along a first intermediate axis 124 (FIG. 8). The second intermediate portion 116 can be arranged along a second intermediate axis 126. In the example provided, the proximal axis 120 and the distal axis 122 can be arranged along transverse and non-intersecting axes. The first intermediate axis 124 can extend along an axis that is generally transverse relative to the distal axis 122. The roller 24 can be rotatably coupled to the distal portion 112. The roller 24 can be rotatably fixed to the distal portion 112 between a pair of lock washers 132 and 134. In the example shown, the lock washer 132 can be lockingly coupled to a recess 136 on the distal portion 112. Similarly, the lock washer 134 can be lockingly engaged to a recess 138 on the distal portion 112.

Figure 9:
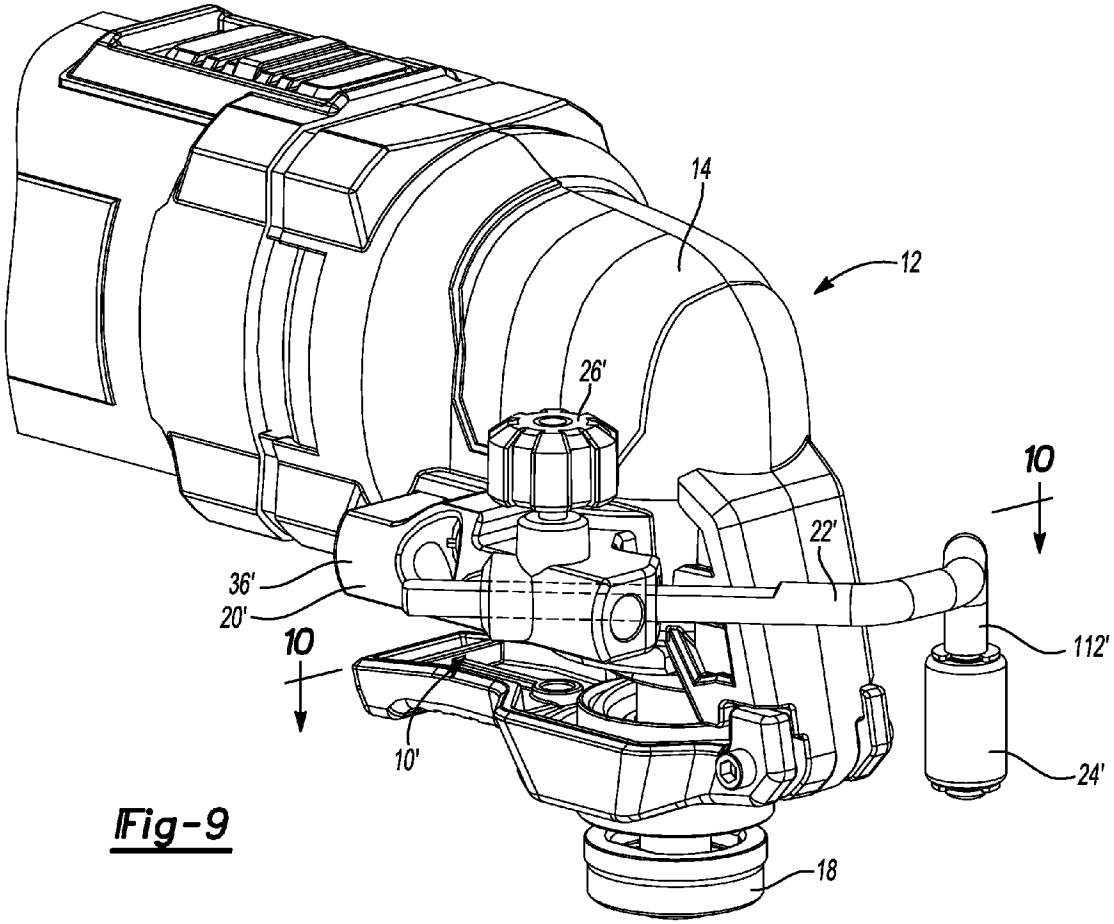
FIG. 9 is a side perspective view of the power tool of FIG. 1 incorporating a repositionable tool accessory constructed for coupling to a second side of the power tool according to the present disclosure.
Figure 10:
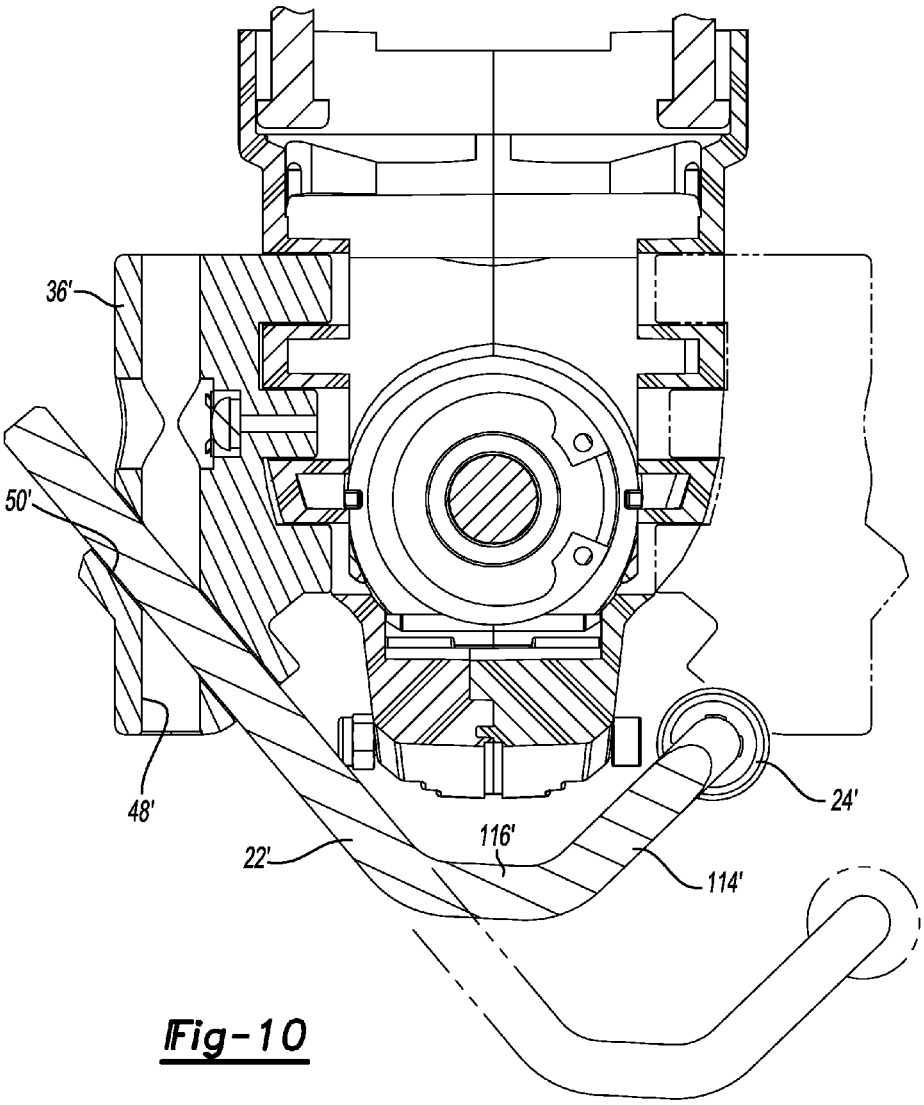
FIG. 10 is a cross-sectional view taken along lines 10-10 of FIG. 9.
Figure 11:
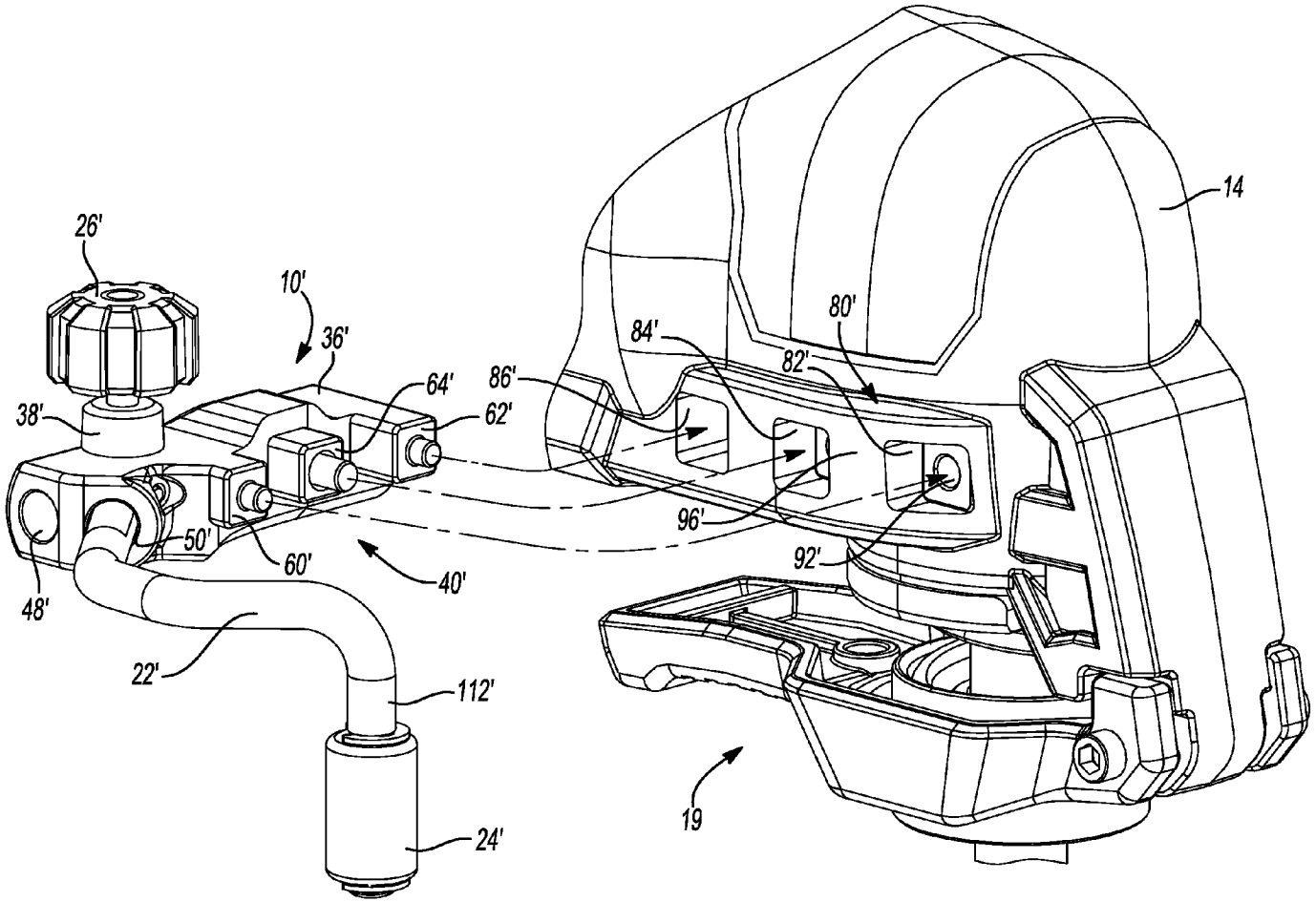
FIG. 11 is a side perspective view of the power tool of FIG. 9 shown prior to coupling the repositionable tool accessory.

With reference now to FIGS. 9-11, a repositionable tool accessory 10' constructed in accordance to additional features of the present disclosure will be described. In general, the repositionable tool accessory 10' can be constructed similarly to the repositionable tool accessory 10 described above. However, the repositionable tool accessory 10' can be configured for coupling to an opposite side of the tool housing 14. In this regard, similar features of the repositionable tool accessory 10' will be shown in the drawings with like reference numerals having a "prime" suffix. The tool housing 14 can generally include a second mounting structure 80'. The second mounting structure 80' can generally comprise a first, second, and third inset 82', 84', and 86', respectively. Again, like reference numerals identified by the second mounting structure 80' are similar to those described above with respect to the first mounting structure 80 but with a "prime" suffix. Of note, when the depth stop rod 22' is located into the second rod opening 50', the second intermediate portion 116' of the depth stop rod 22' can be oriented generally transverse to a long axis of the power tool 12. The second intermediate portion 116' can therefore assist an operator in engaging a working surface and offsetting the power tool 12 a predetermined distance relative to the work piece.

Figure 12:
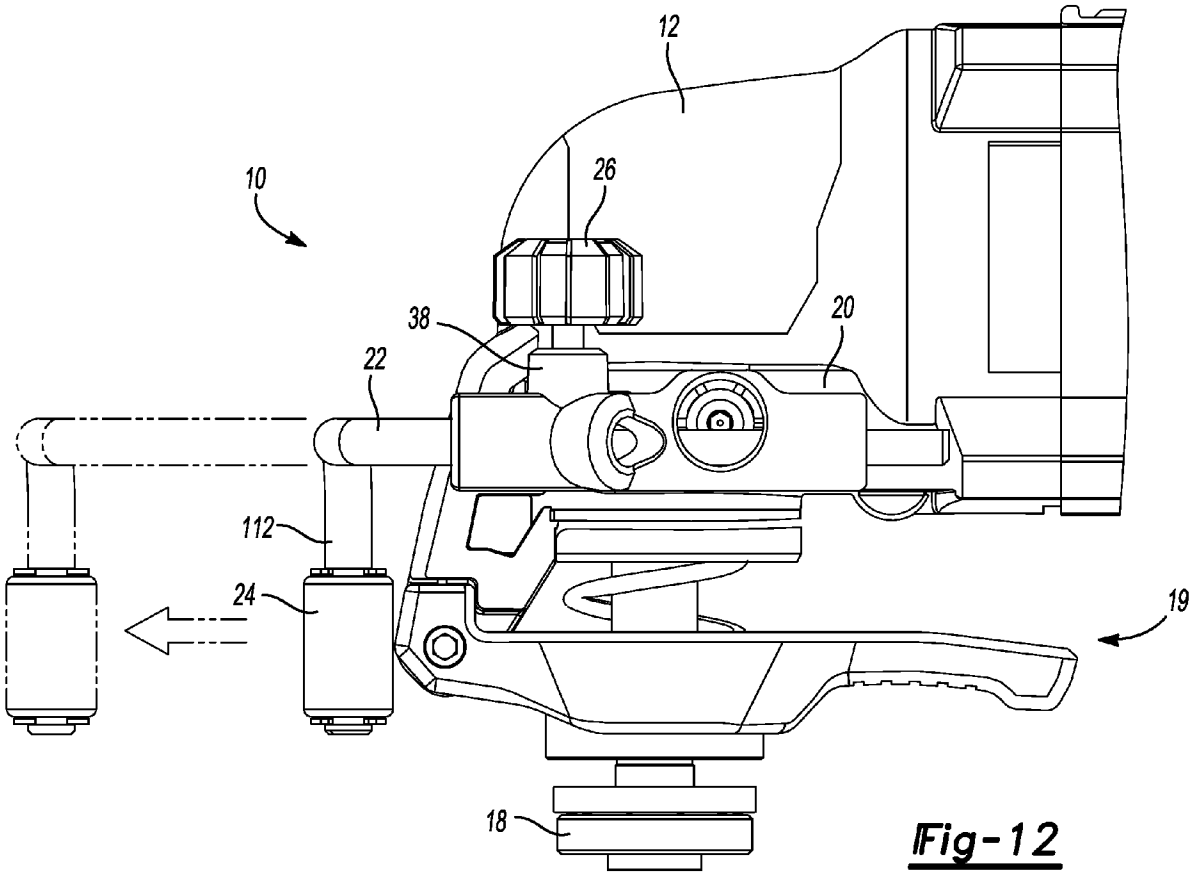
FIG. 12 is a side view of the power tool and repositionable tool accessory of FIG. 1 and shown with a rod and roller moved from a first position to a second position.
Figure 13:
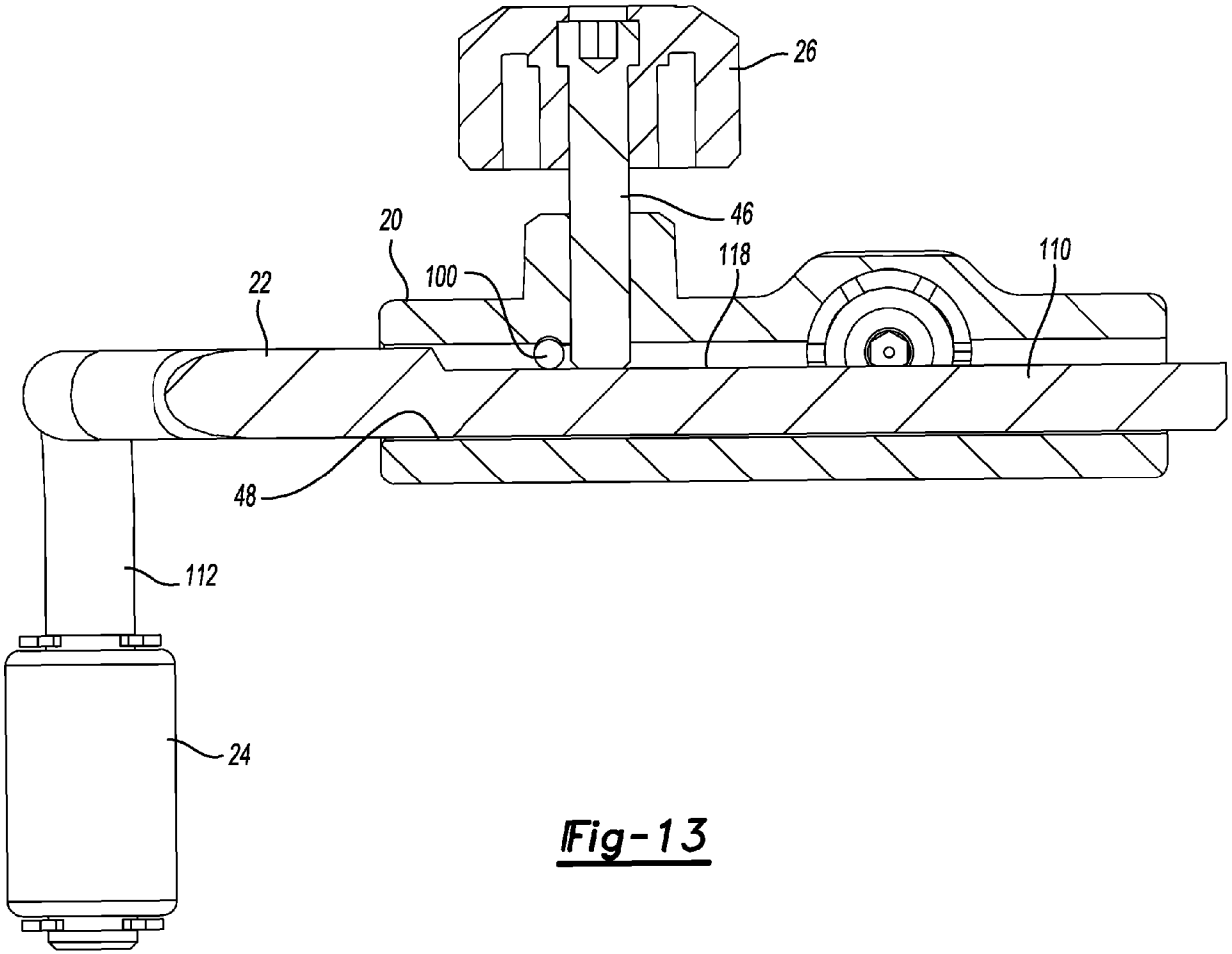
FIG. 13 is a cross-sectional view taken along lines 13-13 of FIG. 1.

Turning now to FIGS. 12 and 13, additional description of the repositionable tool accessory 10 during adjustment thereof will be described. Initially, a user may rotate the locking knob 26 in a loosening direction to move the axle 46 away from engagement with the flat 118 of the depth stop rod 22. A user can then translate the depth stop rod 22 in a direction along the proximal axis 120 (FIG. 8) until a desired location is attained. Once the desired location has been attained, a user can advance the locking knob 26 in a tightening direction such that the axle 46 engages the flat 118 of the depth stop rod 22 and fixes the depth stop rod 22 relative to the tool accessory housing 20. The dowel pin 100 can assist in the smooth translation of the depth stop rod 22 relative to the first rod opening 48 by engaging the flat 118 of the depth rod and thus limiting rotation of the depth stop rod 22 about axis 52. It should also be noted that the dowel pin 100 also assists in smooth translation when the rod is within the other bore 50.

Turning now to FIGS. 14-17, the repositionable tool accessory is shown assisting a user in locating the accessory 30 at a desired location relative to a work piece 32. Specifically, in FIG. 14, the depth stop rod 22 is located in a first position to allow the user to advance the accessory 30 into the work piece 32. FIG. 15 illustrates the depth stop rod 22 moved a distance out of the tool accessory housing 20 to locate the roller 24 at a location to minimize the depth of penetration of the accessory 30 into the work piece 32. FIGS. 16 and 17 illustrate the relative positions of the repositionable tool accessory of FIGS. 14 and 15 but further show how a user may rotate the power tool 12 relative to a work piece 32 while still allowing the roller 24 to roll against a work piece 32 as desired.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A power tool comprising:

a tool housing;

a motor disposed in the tool housing and that drives an output member;

a first mounting structure arranged on the tool housing; and a repositionable tool accessory selectively coupled to the first mounting structure, the repositionable tool accessory comprising:

a tool accessory housing defining a first rod opening and having engaging structure configured to cooperatively mate with the first mounting structure to couple the tool accessory housing to the tool housing;

a rod having a proximal portion, an intermediate portion and a distal portion, the proximal portion of the rod received in and slidably translatable along the first rod opening of the tool accessory housing;

a roller rotatably coupled to the distal portion of the rod; and a locking member coupled to the tool accessory housing and movable between an unlocked position wherein the rod is freely translatable along the first rod opening to locate the roller at different locations relative to the output member and a locked position wherein the rod is fixed relative to the tool accessory housing;

wherein the distal portion of the rod extends along a distal axis, and the proximal portion of the rod extends along a proximal axis, wherein the distal and proximal axes are non-interesting and substantially transverse.

2. The power tool of claim 1 wherein the tool accessory housing further defines a second rod opening, distinct from the first rod opening and configured to selectively and alternatively receive the proximal portion of the rod.

3. The power tool of claim 1 wherein one of the first mounting structure and the engaging structure comprises at least one inset and the other of the first mounting structure and the engaging structure comprises at least one outset, wherein the at least one outset is configured to non-rotatably nest within the at least one inset.

4. The power tool of claim 3 wherein the at least one inset comprises three insets and the at least one outset comprises three outsets.

5. The power tool of claim 4 wherein the insets and outsets have a rectangular geometry.

6. The power tool of claim 3, further comprising a fastener that extends through the at least one inset and outset and threadably engages the mounting structure to fix the tool accessory housing to the tool housing.

7. The power tool of claim 1 wherein the intermediate portion extends along an intermediate axis that intersects with and is substantially transverse relative to the proximal axis.

8. The power tool of claim 1 wherein the rod has a flat formed at the proximal portion, wherein the locking member comprises a locking knob that selectively engages the flat.

9. The power tool of claim 1, further comprising a second mounting structure arranged on an opposite side of the tool housing relative to the first mounting structure, the second mounting structure configured to selectively couple with the engaging structure of said repositionable tool accessory.

10. A repositionable tool accessory configured for a power tool, the repositionable tool accessory comprising:

a tool accessory housing defining a first rod opening and having engaging structure configured to cooperatively mate with a mounting structure on the power tool to couple the tool accessory housing to the power tool;

a rod having a proximal portion, an intermediate portion and a distal portion, the proximal portion of the rod received in and slidably translatable along the first rod opening of the tool accessory housing;

a roller rotatably coupled to the distal portion of the rod; and a locking member coupled to the tool accessory housing and movable between an unlocked position wherein the rod is freely translatable along the first rod opening to locate the roller at different locations relative to the power tool and a locked position wherein the rod is fixed relative to the tool accessory housing;

wherein the tool accessory housing further defines a second rod opening, distinct from the first rod opening, and configured to selectively and alternatively receive the proximal portion of the rod.

11. The repositionable tool accessory of claim 10 wherein one of the first mounting structure and the engaging structure comprises at least one inset and the other of the first mounting structure and the engaging structure comprises at least one outset, wherein the at least one outset is configured to non-rotatably nest within the at least one inset.

12. The repositionable tool accessory of claim 11 wherein the at least one inset comprises three insets and the at least one outset comprises three outsets.

13. The repositionable tool accessory of claim 12 wherein the insets and outsets have a rectangular geometry.

14. The repositionable tool accessory of claim 11, further comprising a fastener that extends through the at least one inset and outset and threadably engages the mounting structure to fix the tool accessory housing to the tool housing.

15. The repositionable tool accessory of claim 10 wherein the distal portion of the rod extends along a distal axis, and the proximal portion of the rod extends along a proximal axis, wherein the distal and proximal axes are non-intersecting and substantially transverse.

16. The repositionable tool accessory of claim 15 wherein the intermediate portion extends along an intermediate axis that intersects with and is substantially transverse relative to the proximal axis.

17. The repositionable tool accessory of claim 10 wherein the rod has a flat formed at the proximal portion, wherein the locking member comprises a locking knob that selectively engages the flat.

18. The power tool of claim 1 wherein the first rod opening extends along a first axis and the second rod opening extends along a second axis, and further wherein the first and second axes are non-parallel and intersecting.

19. The power tool of claim 18 wherein the first and second axes intersect in the tool accessory housing where the locking member is coupled to the tool accessory housing so that the locking member in its locked position can fix the position of the rod relative to the tool accessory housing when the proximal portion of the rod is received in either of said first or second rod openings.

20. The repositional tool accessory of claim 10 wherein the first rod opening extends along a first axis and the second rod opening extends along a second axis, and further wherein the first and second axes are non-parallel and intersecting.

21. The repositional tool accessory of claim 20 wherein the first and second axes intersect in the tool accessory housing where the locking member is coupled to the tool accessory housing so that the locking member in its locked position can fix the position of the rod relative to the tool accessory housing when the proximal portion of the rod is received in either of said first or second rod openings.

22. The repositional tool accessory of claim 10 wherein the locking member comprises a knob coupled to a threaded axle threadably received in the tool accessory housing, and further wherein the threaded axle engages the proximal portion of the rod in the locked position.

* * * * *